United States Patent [19]

Kobayashi et al.

[11] Patent Number: 4,715,348

[45] Date of Patent: Dec. 29, 1987

[54] SELF-DIAGNOSIS SYSTEM FOR EXHAUST GAS RECIRCULATION SYSTEM OF INTERNAL COMBUSTION ENGINE

[75] Inventors: Kiyotaka Kobayashi, Aichi; Hidaka Tsukasaki; Takaaki Baba, both of Kariya, all of Japan

[73] Assignee: Nippondenso Co., Ltd., Kariya, Japan

[21] Appl. No.: 902,964

[22] Filed: Aug. 29, 1986

[30] Foreign Application Priority Data

Aug. 31, 1985 [JP] Japan ..... 60-192844
Aug. 31, 1985 [JP] Japan ..... 60-192845
Oct. 22, 1985 [JP] Japan ..... 60-236783

[51] Int. Cl.[4] ..... F02M 25/06
[52] U.S. Cl. ..... 123/571; 364/431.06
[58] Field of Search ..... 123/569, 568, 571, 479; 364/431.06

[56] References Cited

U.S. PATENT DOCUMENTS 4,375,800 3/1983 Otsuka et al. ..... 123/571
4,432,331 2/1984 Yasuhara ..... 123/571
4,541,398 9/1985 Kishi ..... 123/571

FOREIGN PATENT DOCUMENTS 0197461 11/1983 Japan .
0185857 10/1984 Japan ..... 123/571

OTHER PUBLICATIONS

5/1985 Corvette Shop Manual, Code 32, EGR System Failure, (6E3–48).

*Primary Examiner*—Willis R. Wolfe, Jr.
*Attorney, Agent, or Firm*—Cushman, Darby & Cushman

[57] ABSTRACT

A self-diagnosis system for the exhaust gas recirculation control system of an internal combustion engine comprises a recirculation pipe for returning the exhaust gas to the intake manifold, switching unit for opening or closing the recirculation pipe, control unit for controlling the switching operation of the switching unit, operating conditions detector for detecting the operating conditions of the engine, storage unit for storing the detection values of the detector separately when the switching unit opens and closes, decision unit supplied with the detection values from the storage unit for deciding whether the difference therebetween is in a predetermined range, and an alarm unit for issuing an alarm when the decision unit decides that the difference of the detection values is in the predetermined range, thus making stable self-diagnosis possible with a simple configuration.

9 Claims, 16 Drawing Figures

SELF-DIAGNOSIS SYSTEM FOR EXHAUST GAS RECIRCULATION SYSTEM OF INTERNAL COMBUSTION ENGINE

BACKGROUND OF THE INVENTION

This invention relates to an exhaust gas recirculation control system for returning part of the exhaust gas of an internal combustion engine to the intake manifold thereof, or more in particular to a self-diagnosis system for the exhaust gas recirculation control system.

Conventionally, exhaust gas recirculation control systems of this type (hereinafter referred to as "EGR") find wide applications as means of reducing nitrogen oxides (NOX).

In the case where an operating failure of an EGR valve or EGR pipe clogged causes an EGR fault, NOX is likely to increase extremely. Such an EGR fault, which little affects the operating performance, however, may result in an increased amount of NOX emitted or the pollution of the atmosphere without the knowledge of the driver.

A means to overcome this problem is well known, in which the detected value from a sensor is corrected by the learning control or the like according to a predetermined pattern, such a fault is announced when the correction value exceeds a predetermined value.

Application of the above-mentioned prior art to EGR, however, requires a flow rate sensor or the like to be installed on the EGR pipe for detecting the EGR operating conditions, thereby posing the problem of a complicated construction.

SUMMARY OF THE INVENTION

The object of the present invention, which has been developed with the intention of overcoming the aforementioned problem, is to provide a system of simple construction for deciding with a high accuracy whether the EGR operation of the internal combustion engine is performed normally.

DESCRIPTION OF THE PREFERRED EMBODIMENTS

Figure 1:
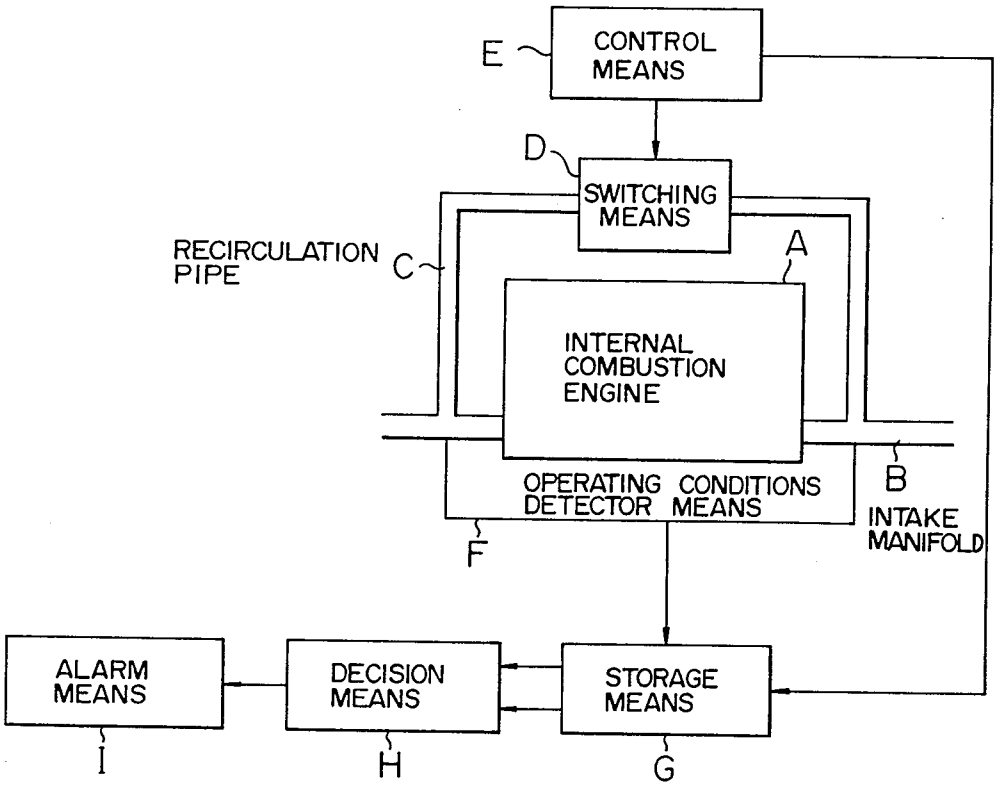
FIG. 1 is a block diagram showing a configuration of the system according to the present invention.

A general configuration of the present invention, as shown in FIG. 1, comprises a recirculation pipe C for recirculating exhaust gas of the internal combustion engine A to the intake manifold B, switching means D for opening or closing the recirculation pipe C, control means E for controlling the opening or closing of the switching means D, operating conditions detector means F for detecting the operating conditions of the internal combustion engine A, storage means G for storing the detection values from the detector means F separately when the switching means D is opened and closed respectively by the control means E, decision means H for deciding whether the difference between the detection values in the storage means G is included in a predetermined range and alarm means I for giving an alarm when the decision means H decides that the difference is included in the predetermined range.

The operating conditions detector means F is for detecting any variation in characteristics caused in the internal combustion engine A depending on the presence or absence of the exhaust gas returned through the recirculation pipe C, and includes sensors for detecting the amount of intake manifold pressure, the amount of fuel injection with a parameter of intake manifold pressure, air-fuel ratio, feedback amount for air-fuel ratio compensation, amount of engine intake air, temperature of gas in engine intake manifold, and so on.

The storage means G, on the other hand, includes a digital memory and an analog memory using a capacitor or the like.

The alarm means I is for notifying the driver of a fault of EGR, and includes a lamp indication or such alarms as character indication or audible alarm.

In the system according to the present invention, the decision means E decides whether or not the EGR is in an operating range, that is, the switching means D is in the "open" range on the basis of a map predetermined by such parameters as the speed of the internal combustion engine or the negative pressure of the intake manifold. Further, decision is made as to whether the engine is in normal operating conditions, and if the above-mentioned operating ranges are met and the conditions for operation are satisfied, the processes mentioned below are performed. Specifically, when the switching means D is open, that is, when the EGR is in the operating range, the detection value from the operating condition detector means F is stored in the storage means G. When the swtiching means D is closed, by contrast, the detection value from the detector means F is stored in the storage means G. These two detection values in the storage means G are compared with each other in the decision means H, and if the difference is decided to be a predetermined value or less, the alarm means I is actuated to inform the driver of a fault of EGR.

Figure 2:
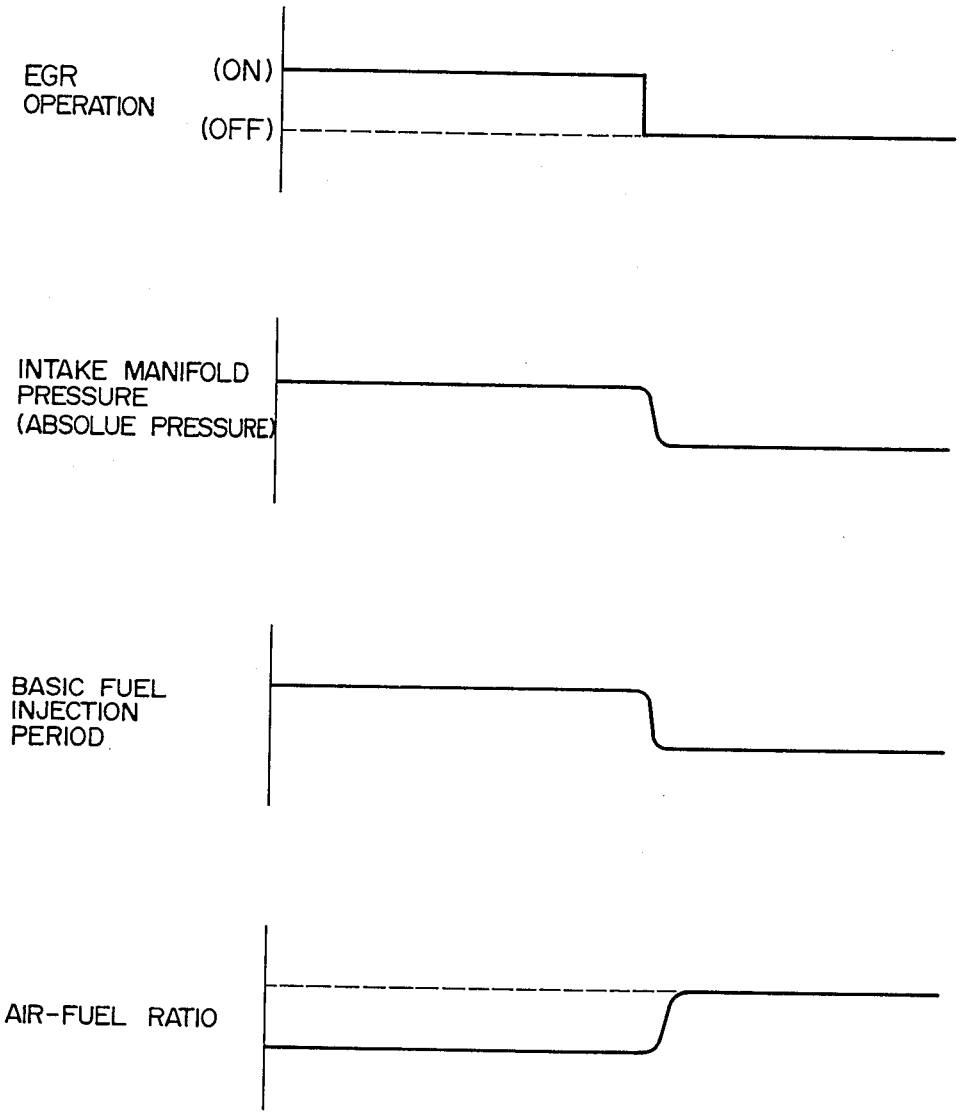
FIG. 2 is a diagram for explaining the operation of the system according to the present invention.

More specifically, as shown in FIG. 2, when EGR is normal, assume that EGR is turned off from on. The pressure in the intake manifold lowers, the basic fuel injection time calculated by the drop in the pressure is shortened, and the air-fuel ratio changes from rich to lean state of the mixture. If there is no expected change beyond a predetermined value, therefore, EGR is decided to be abnormal, thus informing the driver.

Figure 3:
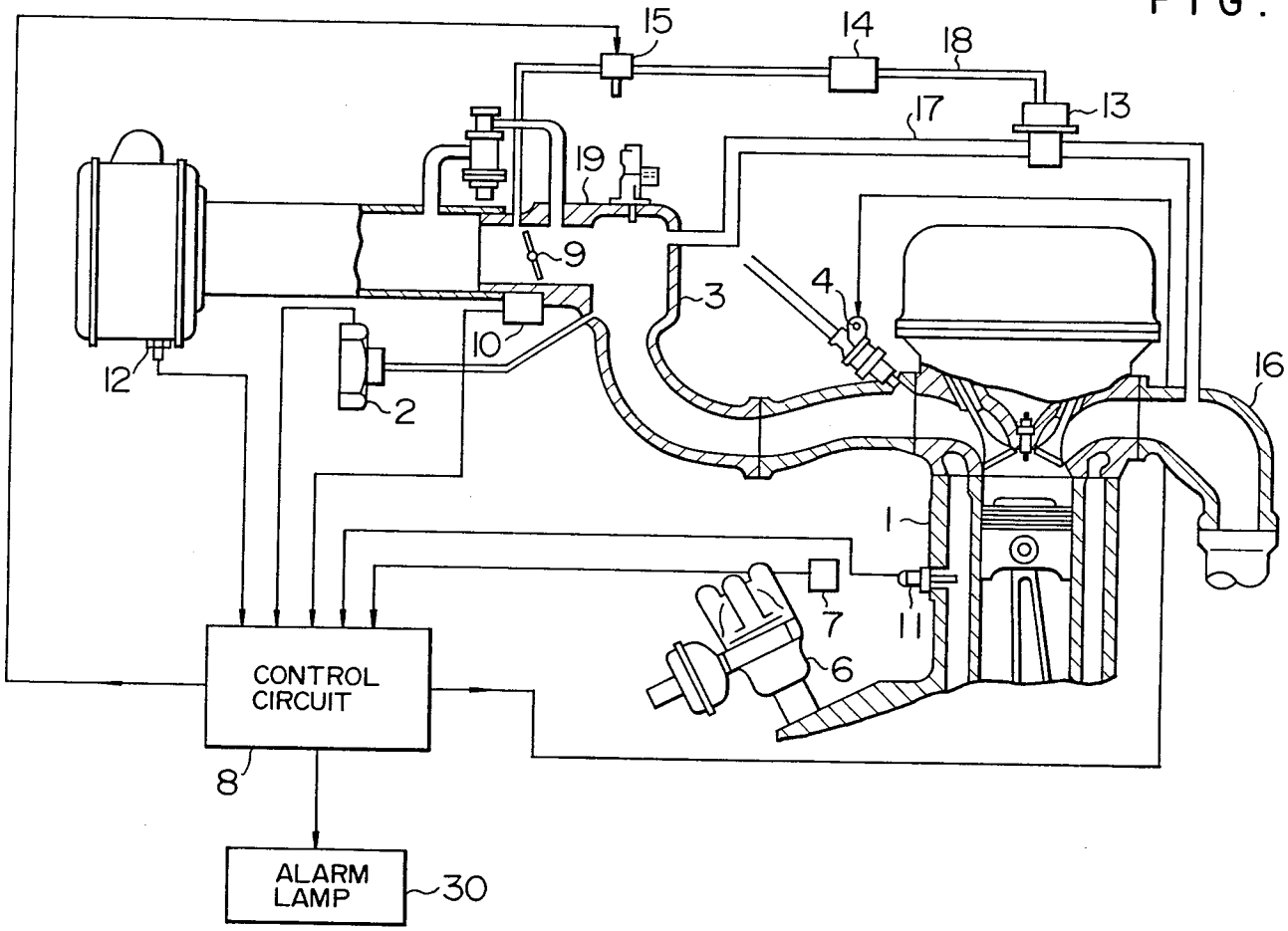
FIG. 3 is a schematic diagram showing a configuration according to an embodiment of the present invention.

FIG. 3 is a diagram showing a specific configuration of the internal combustion engine and a control system to which an embodiment of the present invention is applied.

Reference numeral 1 designates a cylinder of a six-cylinder internal combustion engine, and numeral 2 an intake manifold pressure sensor including a semiconductor-type pressure sensor for detecting the intake air pressure in an intake manifold 3 connected to the cylinder 1. Numeral 4 designates a magnetically-energized fuel injection valve provided in the vicinity of each cylinder intake port of the intake manifold 3, and numeral 6 a distributor. The rotor of the distributor 6 is driven at a rotational speed one-half the engine speed, and has arranged therein a rotary sensor 7 for producing signals representing the engine speed and the fuel injection timing and a cylinder identification signal. Numeral 9 designates a throttle valve, numeral 10 a throttle position sensor for detecting the opening of the throttle valve 9, numeral 11 a water temperature sensor of thermistor type for detecting the temperature of the engine cooling water, and numeral 12 an intake air temperature sensor for detecting the temperature of intake air. Numeral 13 designates an exhaust gas recirculation control valve (hereinafter referred to as "the EGR valve") of vacuum servo type mounted on an exhaust gas circulation path 17 connected between the intake manifold 3 and the exhaust manifold 16. A control path 18 for controlling the EGR valve 13 is connected between the diaphragm chamber of the EGR valve 13 and the inlet of a surge tank 19, and a solenoid valve 15 is installed on this control path 18 for switching the exhaust gas recirculation, together with a modulator 14 for determining the valve opening of the EGR valve 13. The solenoid valve 15 is connected to an output port 107 (FIG. 3) of the electronic control circuit 8, and operates in such a manner to pass the atmospheric air to the modulator 14 during the cold state, idling or high load state, while receiving an energization signal to apply a negative pressure near the throttle valve 9 of the inlet of the surge tank 19 to the modulator 14 at the time of recirculation of the exhaust gas. Numeral 30 designates an alarm lamp for warning about a fault of EGR.

Figure 4:
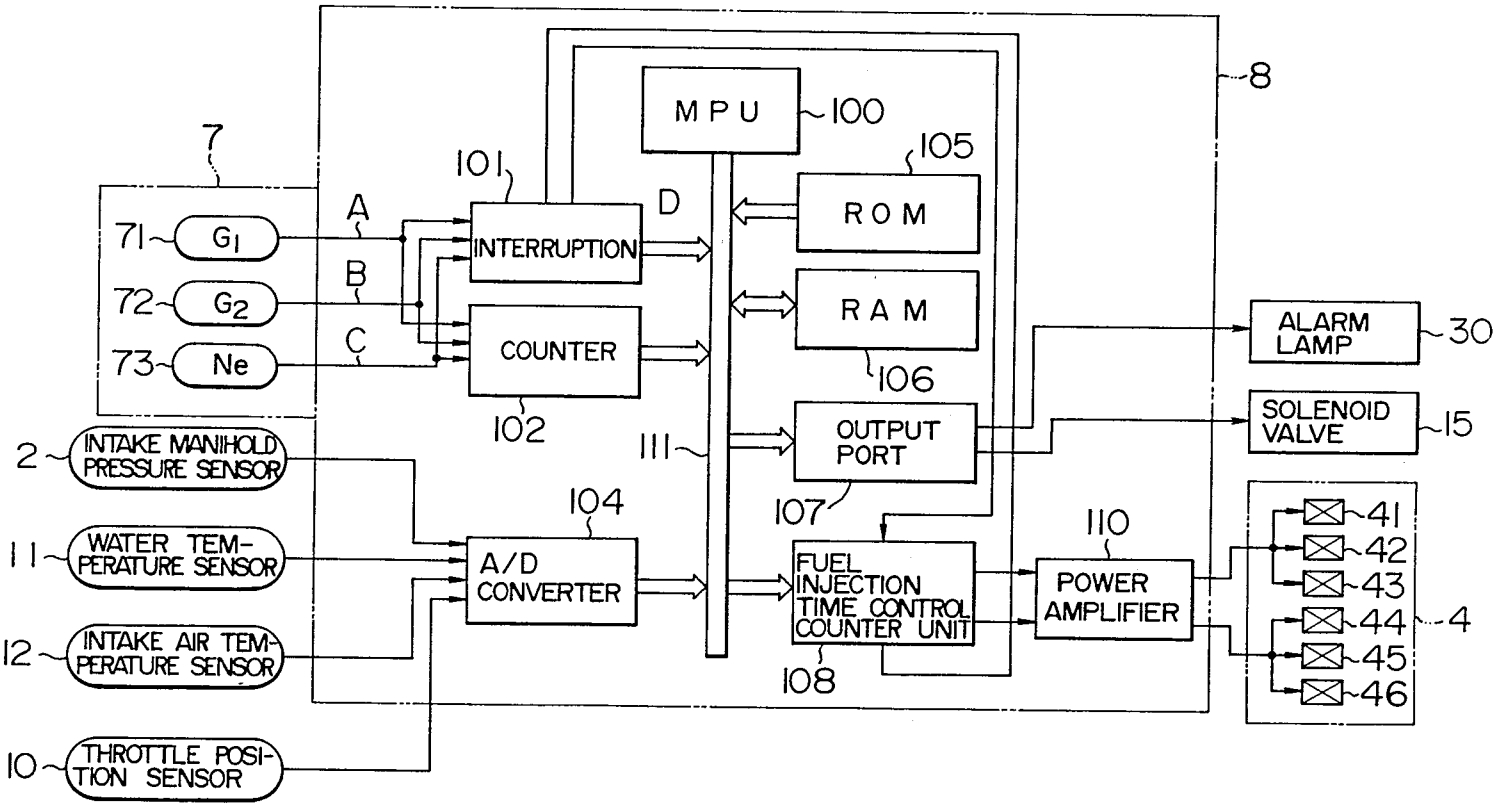
FIG. 4 is a block diagram showing the same embodiment.

FIG. 4 is a block diagram showing the sensors and the electronic control circuit 8 for controlling the air-fuel ratio by controlling the fuel injection amount of the internal combustion engine. The electronic control circuit 8 has a microcomputer as a centerpiece thereof.

The control circuit 8 is supplied with detection signals from the intake manifold pressure sensor 2, revolution sensor 7, throttle position sensor 10, water temperature sensor 11 and the intake air temperature sensor 12, and on the basis of these detection data, computes the amount of fuel injection thereby to control the opening time of the fuel injection valve 4 and the air-fuel ratio. Numeral 100 designates an MPU (microprocessor unit) for executing the computation according to a predetermined program, numeral 101 an interruption control unit for applying an interruption signal to MPU 100, numeral 102 a counter for counting the rotational angle signal from the revolution sensor 7 to calculate the engine speed, and numeral 104 an A/D converter to be supplied selectively with detection signals (analog signals) from the intake manifold pressure sensor 2, water temperature sensor 11 and intake air temperature sensor 12 for converting them into a digital signal. Numeral 105 designates a read-only memory (ROM) for storing the program and map data used for computation, and numeral 106 a non-volatile random access memory (RAM) which holds the memory even after the key switch is turned off. Numeral 107 designates an output port connected to the solenoid valve 15, and numeral 108 an output counter for producing a fuel injection amount (time) control signal including a resistor. This output counter is supplied with the data on the fuel injection amount from MPU 100, and after determining the duty factor of the control pulse signal for controlling the opening time of the fuel injection valve 4 on the basis of this data, produces the fuel injection amount control signal. The control signal produced from the output counter 108 is applied through a power amplifier 110 to the fuel injection valve 4 of each cylinder. The MPU 100, interruption control unit 101, input counter 102, A/D converter 104, ROM 105, RAM 106 and the output counter 108 are connected to a common bus 111 in the control circuit 8, so that required data are transferred in response to a command of MPU 100.

Now, the operation of this system will be explained.

With the start of the internal combustion engine, the MPU decides whether or not the EGR is in the operating range and should be effected from the current detection values of the intake manifold pressure and the engine speed on the basis of the EGR operation map stored in the ROM 105, that is, a map (not shown) with the intake manifold pressure and engine speed as parameters. If it is decided that the EGR is in the operating range, the solenoid valve 15 is energized to apply to the modulator 14 the negative pressure near the throttle valve 9 at the inlet of the surge tank 19, so that the EGR valve 13 is opened thereby to return the exhaust gas to the intake manifold 3.

Figure 5:
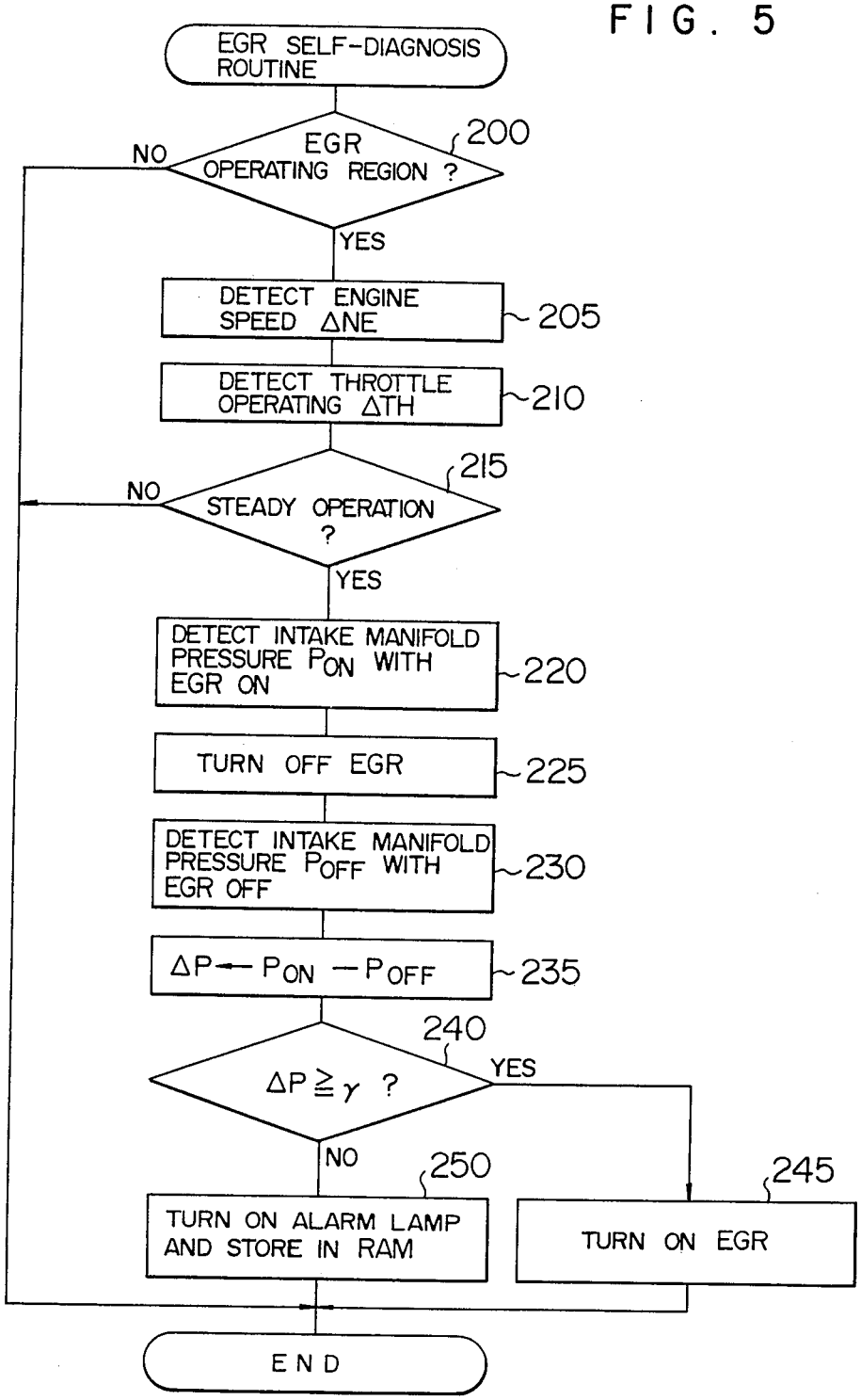
FIG. 5 is a flowchart of the same embodiment.

The self-diagnosis at EGR operating in this way is executed as an interruption process in the flowchart of FIG. 5. Only one interruption is set 30 minutes after the engine start. This is for reducing the number of interruptions of EGR operation which otherwise might result from frequent self-diagnoses.

In the flowchart of FIG. 5, first, step 200 decides whether or the not the EGR should be enabled, and if it is decided that the EGR is in its operating region and EGR should be effected, the process proceeds to step 205 and then to 210. Steps 205 and 210 determine an error $\Delta NE$ of the engine speed NE for a predetermined time and an error $\Delta TH$, of the throttle opening TA for a predetermined time respectively. Step 215 decides whether the error $\Delta NE$ of the engine speed and the error $\Delta TH$ of the throttle opening are smaller than predetermined values $\alpha$ and $\beta$ ($\Delta NE \leqq \alpha$, $\Delta TH \leqq \beta$) respectively. This process is performed to prevent the detection values from being misunderstood as those values for the start, acceleration or deceleration, that is, as those values for unsteady operating state, if the last-mentioned process is executed in any of these states. If the answer is "YES" to both the questions, that is, if it is decided that the steady operation is involved, the process proceeds to step 220, where the pressure on the intake manifold pressure sensor 2 is detected with EGR on (i.e. under effective or enabled state of EGR), and the detection value is stored in RAM 106. At this time, in order to prevent misunderstanding of a sudden pressure change, an average of the detection values Pon for about three seconds is determined. Then, step 225 is executed, and with the solenoid valve 15 energized, the EGR valve 13 is closed thereby to stop the recirculation of the exhaust gas. At step 230, the pressure on the intake manifold pressure sensor 2 with EGR off (disabled) is detected and stored in RAM 106. In this case, as in step 220, the average of the detection values Poff for about three seconds is obtained.

At the next step 235, the pressure difference $\Delta P$ between the detection values Pon and Poff determined at steps 220 and 230 is computed, followed by step 240 for deciding whether $\Delta P \geqq \gamma$. If $\Delta P$ is equal to or larger than the predetermined value $\gamma$, it indicates that it is decided that EGR is normal. The process then proceeds to step 245 where EGR is again enabled, while if $\Delta P$ is smaller than the predetermined value $\gamma$, by contrast, it is decided that EGR is abnormal, so that the process is passed to step 250 where the alarm lamp 30 is lit and a fault data is stored in the self-diagnosis RAM. The alarm on the alarm lamp 30 informs the driver of an EGR fault, thus enabling the driver to take action against the fault.

In other words, there should occur a difference of more than a predetermined value in intake manifold pressure equivalent to the recirculation gas amount returned to the intake manifold 3 between the times when EGR is on and off. If there is not such a difference, a fault is decided and is notified to the driver.

Figure 6:
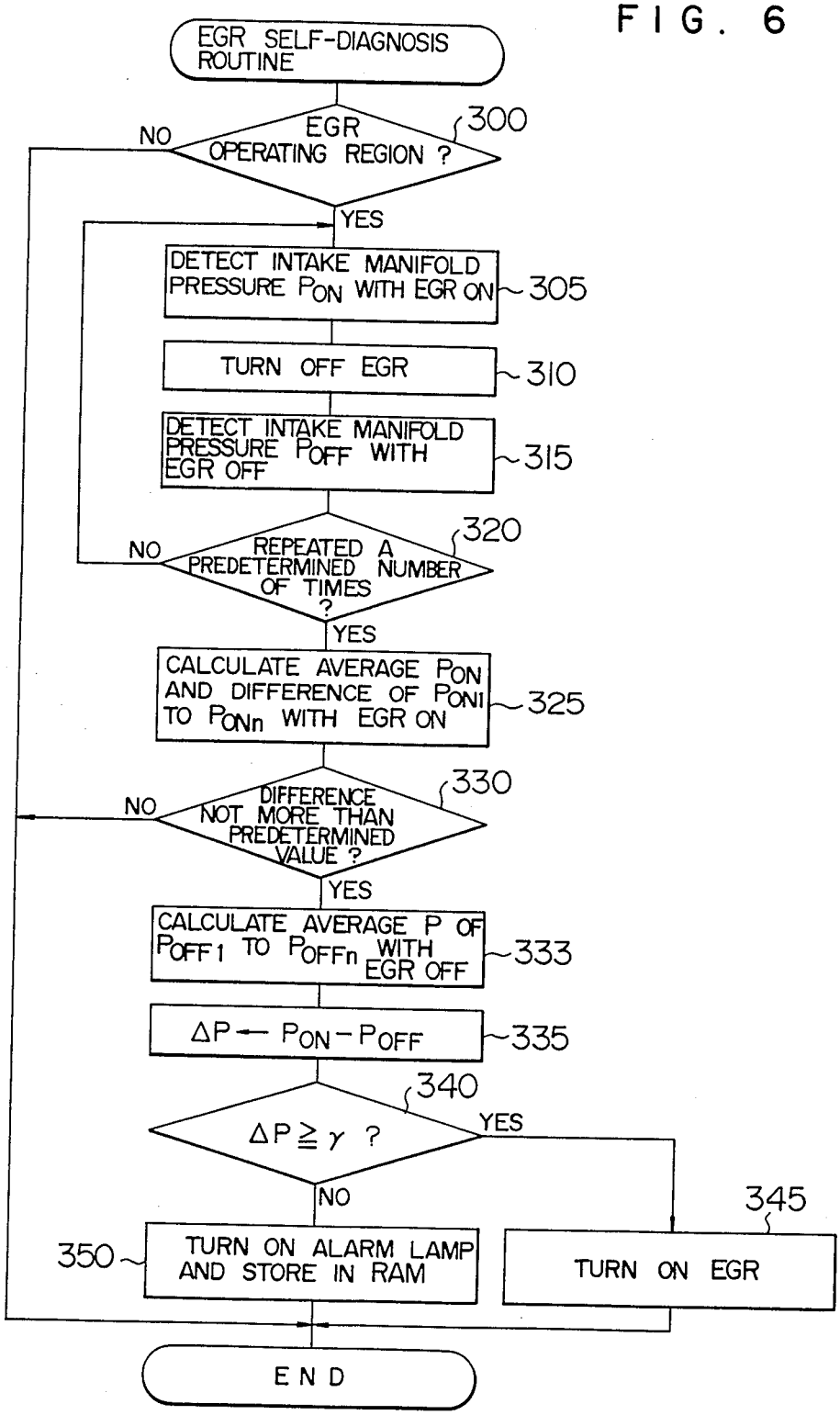
FIGS. 6, 7, 8, 9A–9C, 10, 11A–11C, and 12 are flowcharts for other embodiments.

Another embodiment will be explained with reference to the flowchart of FIG. 6. In the flowchart of FIG. 6, the decision is made as to whether the car is in the steady operating state, by the difference between the intake manifold pressures Pon and Poff detected a predetermined number of times. Specifically, after step 300 where it is decided whether the EGR should be effected or not, steps 305 315 detect the intake manifold pressure Pon and Poff with EGR on and off respectively. These steps are repeated a predetermined number of times according to the decision of step 320. After a predetermined number of repetitions, step 325 calculates the average value of the intake manifold pressures $Pon_1$ to $Pon_n$ and the difference.

The next step is 330 where decision is rendered whether the calculated difference is not more than a predetermined value and if it is not more than the predetermined value, the process is passed to the next step 333. Specifically, if step 333 decides that a predetermined range is met, it indicates that the change in the intake manifold pressure Pon is small, and therefore a steady operating state is decided, with the process passed to step 333. Step 333 calculates the average value $\overline{P}off$ of $Poff_1$ to $Poff_n$ with EGR off, followed by step 335 for calculating the pressure difference $\Delta P$ ($=\overline{P}on-\overline{P}off$) between the average intake manifold pressures $\overline{P}on$ and $\overline{P}off$. Step 340 decides whether this pressure difference $\Delta P$ is not less than $\gamma$($\gamma$: Positive number), and if the answer is "YES", it indicates that the decision is made that EGR is normal (step 345), thereby turning on and restoring the EGR. If the answer is "NO", on the other hand, the alarm lamp 30 is lit, informing the driver of the EGR fault, while at the same time storing the information in RAM (step 350).

In the aforementioned embodiment, the changed value of the intake manifold pressure is used for deciding a fault of EGR. Instead, decision may be made from the basic fuel injection amount with the intake manifold pressure as a parameter, or the detection value from the air-fuel ratio sensor, the feedback correction of the air-fuel ratio determined by integrating the output of the air-fuel ratio sensor, or the detection value of the operating conditions varying by turning on and off of EGR, may be used with an effect similar to the above-mentioned embodiment.

Another embodiment of the present invention will be explained below.

First, with reference to FIG. 7, explanation will be made of an example of the EGR self-diagnosis having an intake air amount sensor for detecting the amount of engine intake air as a means of detecting the operation conditions in FIG. 1. The flowchart of FIG. 5 is basically applied to the present case, and therefore, only the differences therefrom will be explained briefly.

Figure 7:
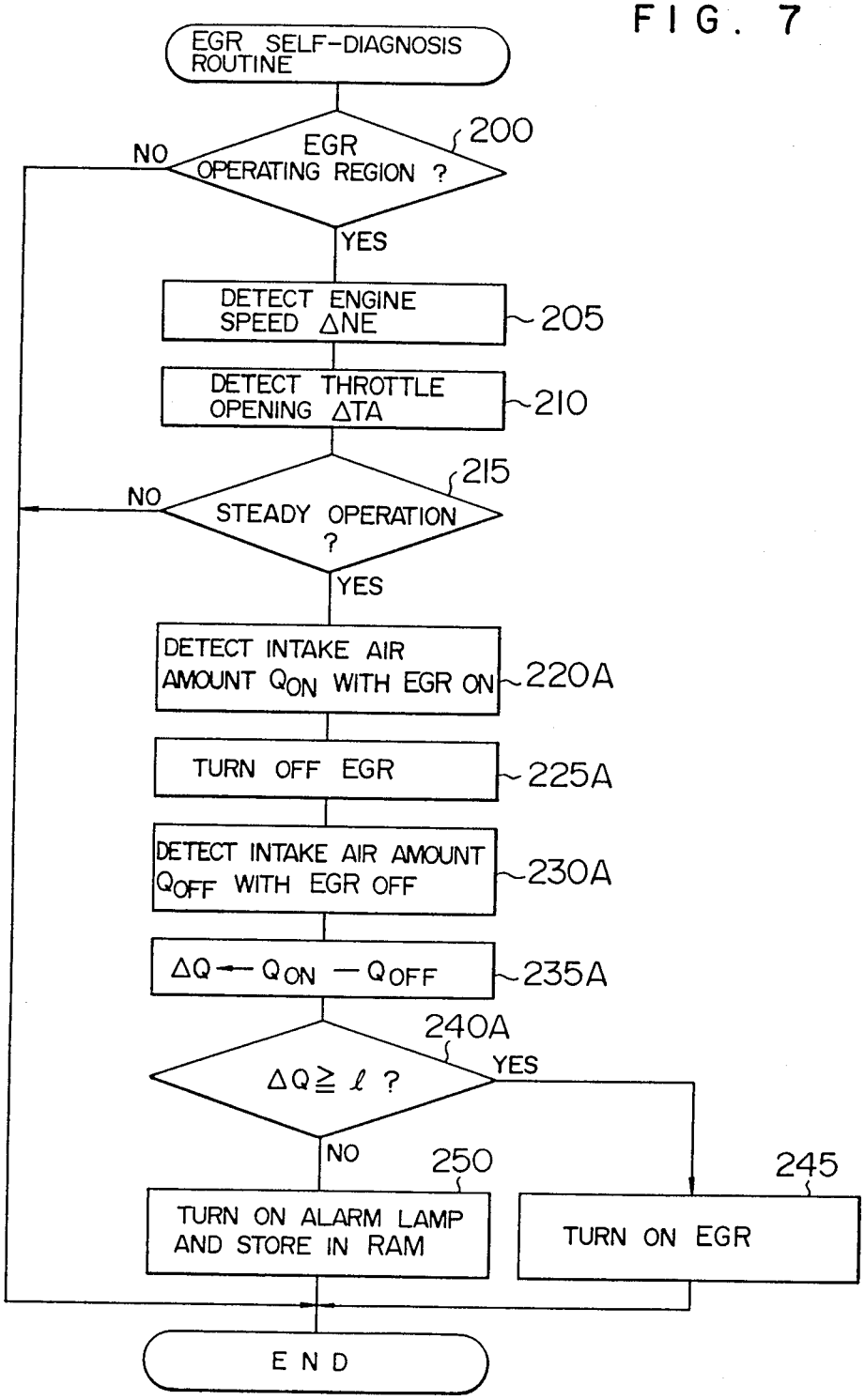

Steps 220A to 240A in FIG. 7 detect and store the intake air amount with EGR on. In the process, in order to prevent detection errors against the change in intake air amount, an average Qon of the detection values of the intake air amount for a period of about three seconds is obtained. In similar fashion, while EGR is off, the average Qoff of the detection values of the intake air amount for a period of about three second is determined. The difference $\Delta Q$ between these two average values ($\Delta Q=Qon-Qoff$) is calculated, and by deciding at step 240A whether $\Delta Q$ is not less than l, whether EGR is faulty or not is determined.

Now, with reference to FIG. 8, explanation will be made of an example having a temperature sensor for detecting the gas temperature in the engine intake manifold as a means of detecting the operating conditions in FIG. 1. This example is for deciding that EGR is abnormal if the temperature difference before and after switching of the EGR valve is not more than a predetermined value.

Specifically, the above-mentioned process is performed by deciding the water temperature (step 400) and the lapse of time from the switching operation of the EGR valve 13 (step 410), followed by the decision as to whether the EGR valve 13 is in operation (step 420), and if the EGR valve 13 is in operation, the temperature T is detected (step 430) is set to the high temperature memory TH (step 440). If the EGR valve 13 is not in operation as it is switched off, by contrast, the temperature T is detected (step 480) and is set to the low-temperature memory TL (step 490). Then, the process is performed to prevent a decision error which might be caused by the memories TH and TL cleared in initial stage of operation (steps 445, 495), followed by step 450 for determining the difference $\Delta TS$ between the high-temperature memory TH and the low-temperature memory LH. The difference $\Delta TS$ is compared with the predetermined criterion C (step 460), and if $\Delta TS \leqq C$, the alarm lamp 30 is lit while at the same time storing the result of comparison in RAM 106 (step 470).

Figure 8:
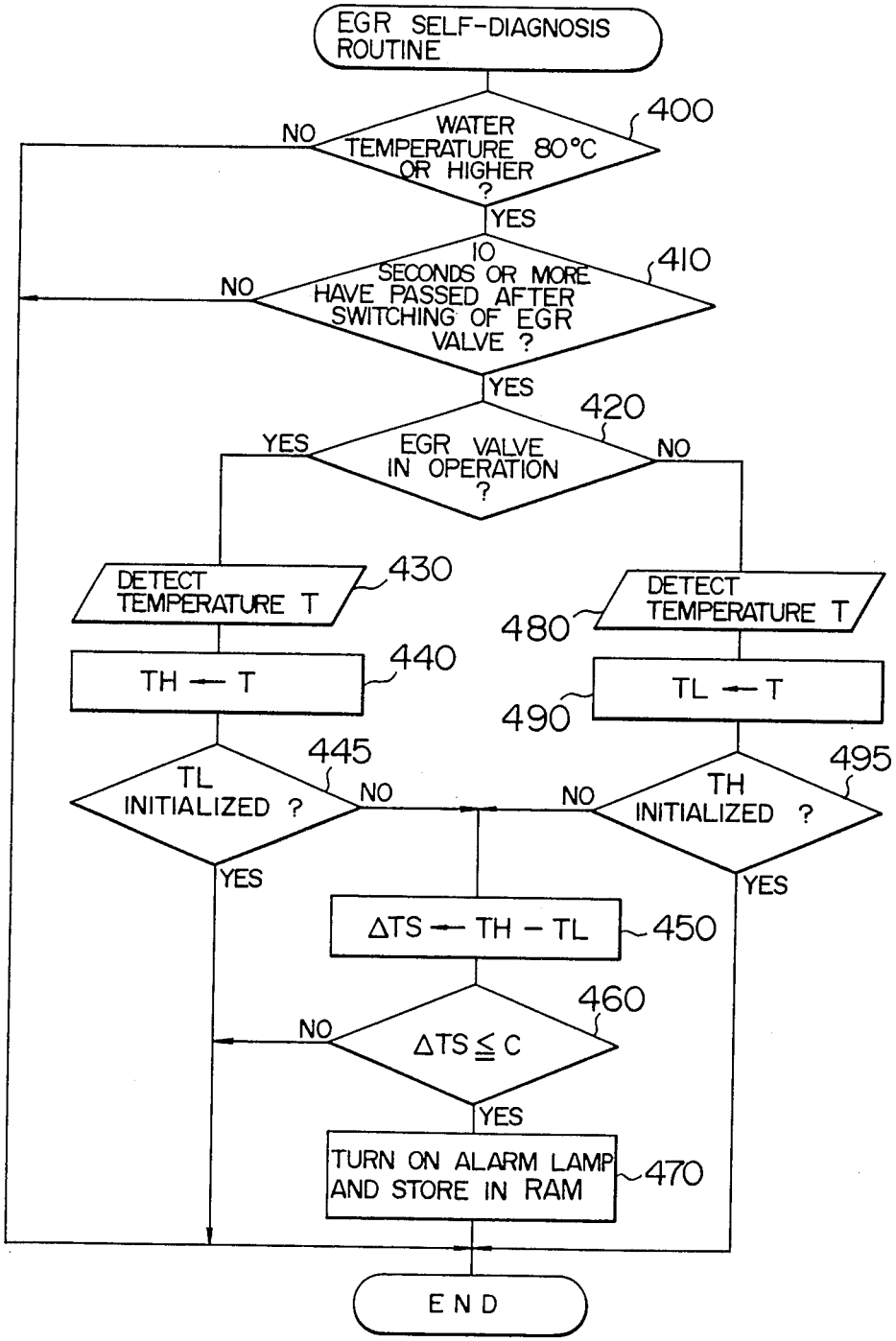

The embodiment shown in FIG. 8 enables an EGR fault to be notified, thereby making it possible to shoot the trouble. Further, according to the embodiment under consideration, the temperature difference before and after the switching of the EGR valve 13 is detected, and therefore any abnormal condition or fault can be notified without error against the variation in characteristics caused by the deterioration of the temperature sensor or the change in a wide range of intake air or exhaust gas temperature.

Figure 9:
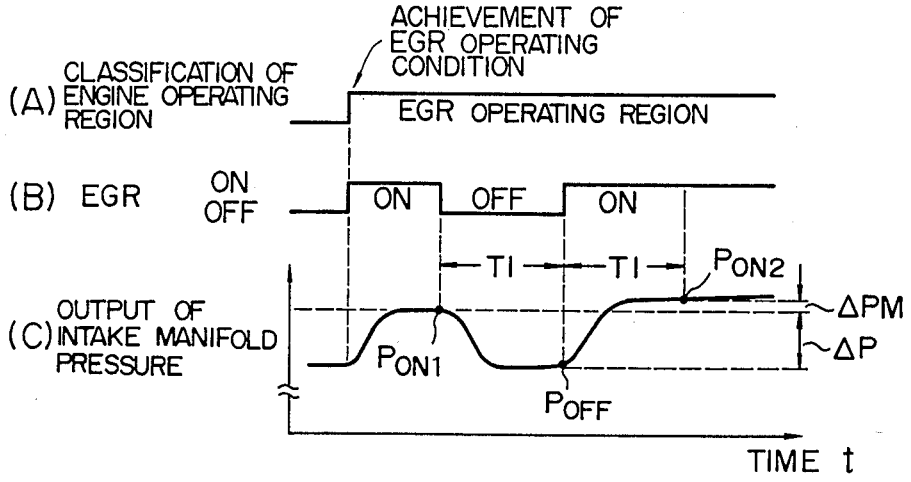

Still another embodiment will be explained with reference to FIGS. 9 and 10. In this embodiment, as shown in FIG. 9, when the engine enters the EGR operating range, the intake manifold pressure $Pon_1$ with EGR on for the first time is determined thereby to turn off the EGR, and after the lapse of a predetermined length of time Tl from that, the intake manifold pressure Poff with EGR off is determined thereby to turn on the EGR again, so that after the lapse of a predetermined time period Tl from that point, the intake manifold pressure $Pon_2$ with the EGR on for the second time is determined. If the decision is that $Pon_1 \approx Pon_2$, the difference $\Delta P$ between $Pon_1$ and Poff is determined.

This eliminates the need of detecting the output of other sensors or the like for deciding on the normal operation of the engine on the one hand, and whether steady operation is decided at the time of detection of the intake manifold pressure on the other hand, thereby improving the decision accuracy and the reliability.

Figure 10:
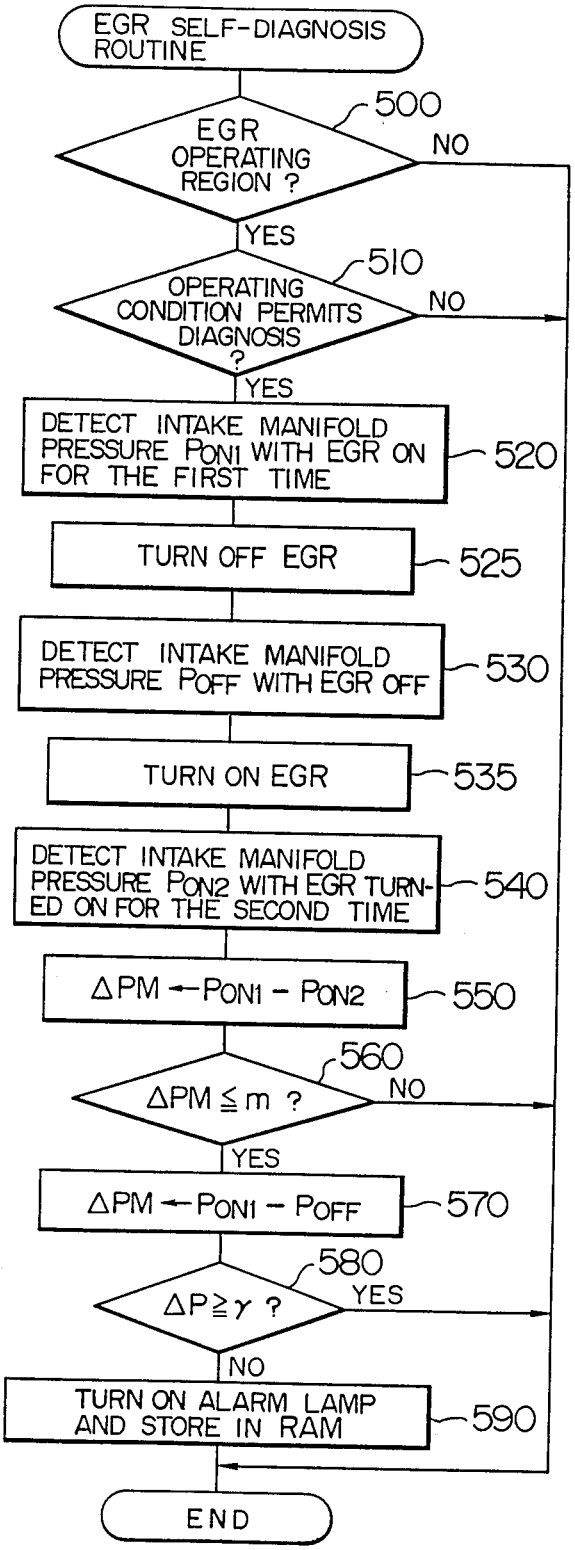

Next the flowchart of FIG. 10 is referred to. First, steps 500 and 510 decide that the engine is in EGR operating range and the operating conditions such as the engine speed and intake manifold pressure are in a set region capable of self-diagnosis. After that, the EGR valve 13 is operated by the control means E in FIG. 1, thereby detecting the intake manifold pressure $Pon_1$ with EGR on for the first time, the intake manifold pressure Poff with EGR off, and the intake manifold pressure $Pon_2$ with EGR on for the second time, sequentially (steps 520 to 540). Only to the extent that the difference ΔPM between $Pon_1$ and $Pon_2$ is included in an allowable range and therefore the engine is considered substantially in a normal operating condition, steps 550 to 580 decide whether the difference ΔP between $Pon_1$ and Poff is not less than a predetermined value. If the value ΔP is less than the predetermined lavel, it is decided that EGR is abnormal, and an alarm is issued (step 590).

Figure 11:
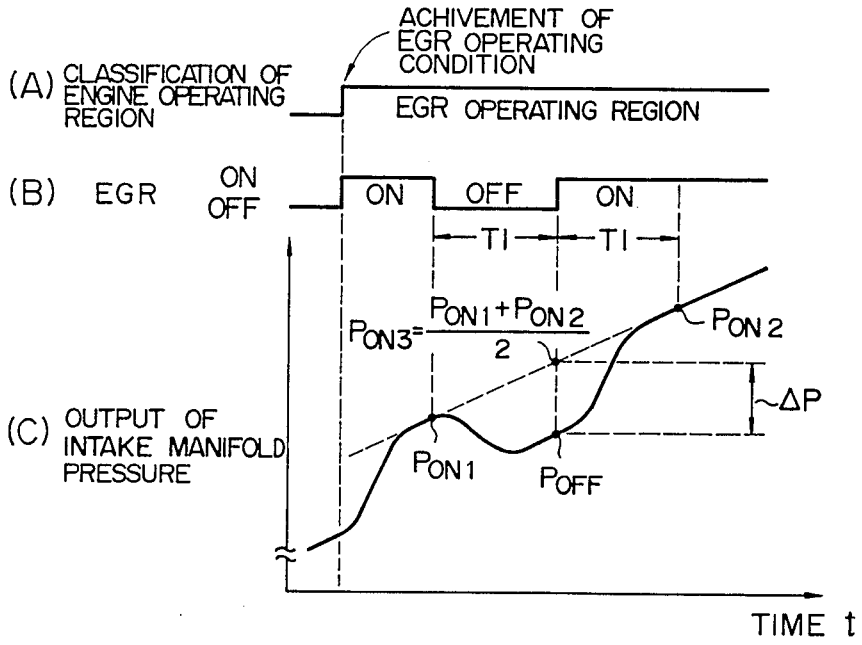
Figure 12:
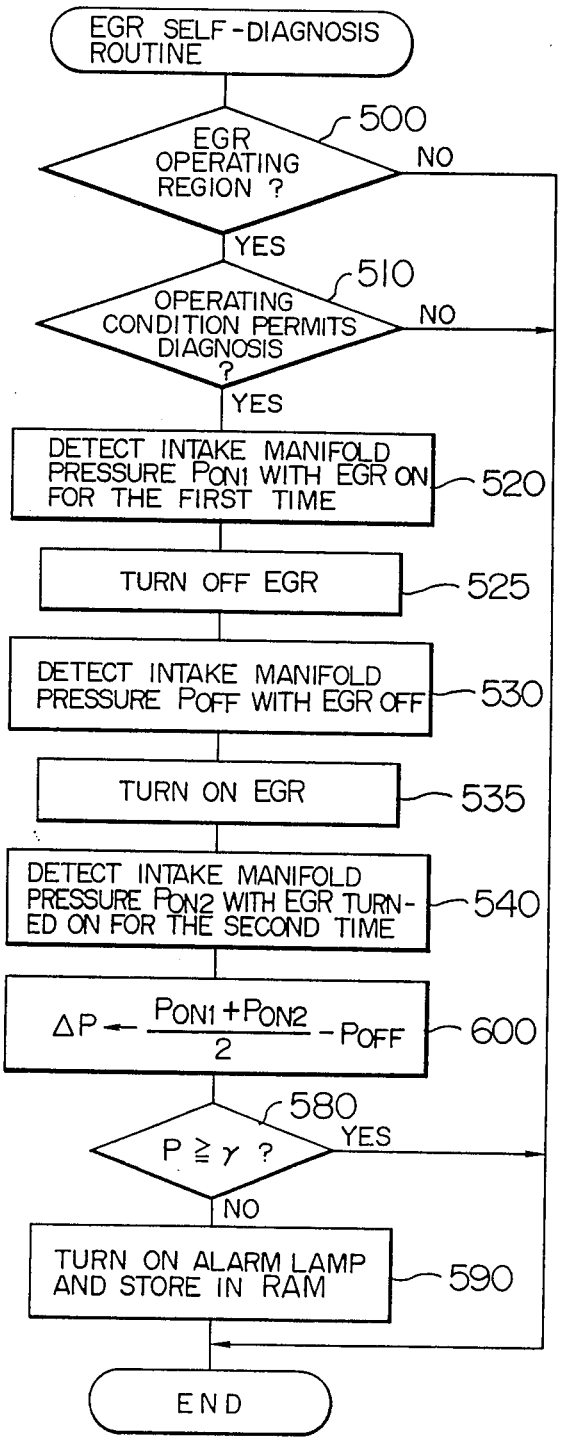

A further embodiment is shown in FIGS. 11 and 12. While the self-diagnosis of EGR is made during the steady engine operation in the aforementioned embodiments, the self-diagnosis is possible also during unsteady operations.

Specifically, as shown in FIG. 11, when the engine enters the EGR operating range, the intake manifold pressure $Pon_1$ with EGR on for the first time, the intake manifold pressure Poff with EGR off, and the intake manifold pressure $Pon_2$ with EGR on for the second time are determined in the same manner as in the embodiment of FIG. 9. From these values $Pon_1$ and $Pon_2$, the intake manifold pressure $Pon_3$ with EGR assumed to be on at the time of detection of the intake manifold pressure Poff is estimated. In this case, the intervals of detection timings are the same, and therefore $Pon_3=(Pon_1+Pon_2)/2$, so that ΔP is determined from the difference between this value $Pon_3$ and Poff to perform the self-diagnosis.

The flowchart of FIG. 12 will be explained. The difference of this flowchart from that of FIG. 10 lies only between step 600 in FIG. 12 and steps 550, 560 and 570 in FIG. 10. In the flowchart of FIG. 12, the intake manifold pressure $Pon_3(=(pon_1+Pon_2)/2)$ is estimated with an assumed on state of EGR is estimated at the time of detection of Poff, so that the difference ΔP can be detected with high accuracy even during the unsteady operation from $\Delta P=Pon_3-Poff$, thereby making possible stable self-diagnosis.

It will thus be understood from the foregoing description that according to the present invention self-diagnosis of the EGR is possible by comparing the operating conditions detecting means between the time of opening and closing the EGR valve, and therefore the flow rate sensor or the like is eliminated on the recirculation pipe unlike in the conventional self-diagnosis system, thereby simplifying the configuration.

Futther, a clogged state of the recirculation pipe can be detected from the fact that the difference between detection values is reduced, thus making it possible to detect a fault easily.

We claim:

1. A self-diagnosis system for an exhaust gas recirculation system mounted on an internal combustion engine which produces an exhaust gas, the engine having an intake passage, said system comprising:

recirculation passage means for selectively recirculating said exhaust gas from an exhaust passage of said engine to said intake passage of said engine;

valve means for opening and closing said recirculation passage means;

detector means for detecting a predetermined operating parameter of said engine and generating values therefrom, said detector means being provided at a location other than said recirculation passage means, and said predetermined operating parameter being one which is influenced by said exhaust gas recirculated through said recirculation passage means;

storage means for storing values of said operating parameter detected by said detector means when said recirculation passage means is opened and closed, respectively;

means for calculating a difference between said detected values of said operating parameter stored in said storage means; and means for comparing said calculated difference with a predetermined reference thereby to discriminate whether or not said exhaust gas recirculation system is in an abnormal state.

2. A system according to claim 1, wherein said detector means comprises a temperature detector mounted on said engine for detecting a temperature of an engine coolant water.

3. A system according to claim 1, wherein said detector means comprises a pressure detector mounted on said engine for detecting an intake air pressure in said intake passage.

4. A system according to claim 1, further comprising means for detecting a steady state of said engine, and wherein said valve means opens and closes said recirculation passage means when said steady state is detected so that said difference between said detected values is calculated by said calculating means during said detected steady state of said engine.

5. A self-diagnosis system for an exhaust gas recirculation system of an internal combustion engine which has an intake manifold pressurized with an intake manifold pressure, said engine also producing an exhaust gas, said system comprising:

a recirculation pipe for selectively recirculating said exhaust gas of said internal combustion engine to said intake manifold;

switching means for opening and closing said recirculation pipe;

control means for controlling a switching operation of said switching means;

operating condition detector means for detecting operating conditions of said internal combustion engine and generating therefrom detection values;

storage means for storing said detection values from said operating condition detector means, said detection values stored separately when the switching means is respectively opened and closed by the control means;

decision means for determining whether a difference between said detection values is within a predetermined range, in accordance with said detection values from said storage means; and alarm means for issuing an alarm when said decision means determines that said difference between said detection values is included in said predetermined range.

6. A self-diagnosis system according to claim 5, wherein said operating condition detector means includes at least one of (a) an intake pressure sensor for detecting said intake manifold pressure of said engine, (b) an intake air amount sensor for detecting an amount of air taken into said engine and (c) a temperature sensor for detecting a gas temperature in said intake manifold.

7. A self-diagnosis system according to claim 5, wherein said operating condition detector means is an intake air pressure sensor for detecting said engine intake manifold pressure, and said decision means determines and stores a fault when the difference between the detection values of the intake air pressure from the storage means is included in a predetermined range.

8. A self-diagnosis system according to claim 7, wherein said decision means determines an average of each of said detection values of intake manifold pressure from said storage means, and determines a fault from a difference between said average values.

9. A self-diagnosis system according to claim 7, further comprising steady state decision means for determining that the engine is in a steady state and for permitting said determination by said decision means when two detection values of intake manifold pressure, respectively determined with said switching means opened for first and second times successively by said control means, are substantially equal to each other.

* * * * *